US007384721B2

(12) United States Patent
Eida et al.

(10) Patent No.: US 7,384,721 B2
(45) Date of Patent: Jun. 10, 2008

(54) TONER FOR ELECTROSTATIC IMAGE DEVELOPMENT

(75) Inventors: Akihiro Eida, Wakayama (JP); Jun Shimizu, Wakayama (JP)

(73) Assignee: Kao Corporation, Tokyo (JP)

( * ) Notice: Subject to any disclaimer, the term of this patent is extended or adjusted under 35 U.S.C. 154(b) by 348 days.

(21) Appl. No.: 11/102,745

(22) Filed: Apr. 11, 2005

(65) Prior Publication Data

US 2005/0233238 A1 Oct. 20, 2005

(30) Foreign Application Priority Data

Apr. 15, 2004 (JP) ..... 2004-120853

(51) Int. Cl.
*G03G 9/08* (2006.01)

(52) U.S. Cl. ..... 430/108.7; 430/108.1; 430/137.18

(58) Field of Classification Search ..... 430/108.7, 430/108.1, 137.18
See application file for complete search history.

(56) References Cited

U.S. PATENT DOCUMENTS 6,171,744 B1 * 1/2001 Nakazawa et al. ..... 430/108.6
7,078,144 B2 * 7/2006 Ota et al. ..... 430/137.2
2003/0186153 A1 10/2003 Ishihara et al.
2004/0137358 A1 * 7/2004 Nozawa et al. ..... 430/137.21
2005/0130052 A1 * 6/2005 Tsunemi ..... 430/108.4

FOREIGN PATENT DOCUMENTS

JP 2003-295505 10/2003

OTHER PUBLICATIONS

U.S. Appl. No. 11/102,719, filed Apr. 11, 2005, Eida, et al.
Patent Abstracts of Japan, JP 11-202551, Jul. 30, 1999.
Patent Abstracts of Japan, JP 9-204062, Aug. 5, 1997.
Patent Abstracts of Japan, JP 2002-014487, Jan. 18, 2002.

* cited by examiner

*Primary Examiner*—John L Goodrow
(74) *Attorney, Agent, or Firm*—Oblon, Spivak, McClelland, Maier & Neustadt, P.C.

(57) ABSTRACT

The present invention relates to a toner for electrostatic image development, obtainable by a process including the steps of (I) melt-kneading a raw material mixture comprising a resin binder, a releasing agent, and a colorant; cooling the melt-kneaded mixture; and pulverizing the cooled mixture; and (II) further pulverizing a pulverized product obtained in the step (I) in the presence of an external additive; and classifying the pulverized product, wherein the releasing agent in the step (I) contains a wax having a melting point of from 65° to 100° C., and wherein the external additive in the step (II) contains specified inorganic oxides. The toner of the present invention can be suitably used, for instance, for the development of a latent image formed in electrophotography, electrostatic recording method, electrostatic printing method or the like.

23 Claims, No Drawings

TONER FOR ELECTROSTATIC IMAGE DEVELOPMENT

FIELD OF THE INVENTION

The present invention relates to a toner for electrostatic image development used, for instance, for the development of a latent image formed in electrophotography, electrostatic recording method, electrostatic printing method or the like, and a process for preparing the same.

BACKGROUND OF THE INVENTION

JP-A-Hei-9-204062 discloses a technique relating to an electrostatic image developer containing a first hydrophobic silica and a second hydrophobic silica in a specified ratio.

JP-2003-295505 A discloses a technique relating to a developer obtained by melt-kneading at least a resin binder and a colorant, subjecting the resulting kneaded mixture to a rough pulverization, thereafter adding an external additive, subjecting the resulting mixture to a fine pulverization, and classifying the finely pulverized product.

JP-A-Hei-11-202551 discloses a technique relating to a process for preparing a color toner including the steps of pulverizing a mixture of a melt-kneaded mixture containing a resin binder, a wax and an organic chromatic colorant with fine inorganic oxide particles, and classifying the resulting pulverized product, whereby the feed of a releasing agent to a heat roller can be made as little as possible, thereby obtaining excellent color fixed images.

SUMMARY OF THE INVENTION

The present invention relates to a toner for electrostatic image development, obtainable by a process comprising the steps of:

(I) melt-kneading a raw material mixture comprising a resin binder, a releasing agent, and a colorant; cooling the melt-kneaded mixture; and pulverizing the cooled mixture; and (II) further pulverizing a pulverized product obtained in the step (I) in the presence of an external additive; and classifying the pulverized product, wherein the releasing agent in said step (I) comprises a wax having a melting point of from 65° to 100° C., and wherein the external additive in said step (II) comprises an inorganic oxide subjected to hydrophobic treatment having an average particle size of 4 nm or more and less than 20 nm (hereinafter referred to as an "inorganic oxide A"), and an inorganic oxide subjected to hydrophobic treatment having an average particle size of 20 nm or more and 100 nm or less (hereinafter referred to as an "inorganic oxide B"); and a process for preparing the toner.

DETAILED DESCRIPTION OF THE INVENTION

The present invention relates to a toner for electrostatic image development having excellent dot reproducibility not only at the initial stage of printing but also during durability printing even in an oil-less electrostatic image developer device, and a process for preparing such a toner.

According to the present invention, a toner for electrostatic image development having excellent dot reproducibility not only at the initial stage of printing but also during durability printing even in an oil-less electrostatic image developer device, and a process for preparing such a toner can be provided.

These and other advantages of the present invention will be apparent from the following description.

In the trends of widespread use of full color printers and miniaturization thereof, there are increasing demands for high image qualities and high durability as well as the demands for oil-less fixing of full color toners. Especially, in an oil-less electrostatic image developer device having high speed and high image quality, improvement in the stability in dot reproducibility of the toner at the initial level as well as during the course of a long-term printing for numerous times is important (hereinafter also referred to as "durability printing property").

In order to improve the dot reproducibility of the toner at the initial level as well as the durability printing property, since the dot reproducibility greatly depends on the chargeability of the toner, it is effective to stabilize the chargeability of the toner.

As a means of stabilizing the chargeability of the toner, studies have been conventionally made on selection of an appropriate external additive. However, for instance, in the toner disclosed in JP-A-Hei-9-204062, although the improvement of the stability in the dot reproducibility can be anticipated at the initial level, it is difficult to maintain the dot reproducibility of the initial level in the long-term printing for numerous times. Although not wanting to be limited by theory, this is presumably due to the fact that since the adhesion of the external additive to the toner is instable, the chargeability of the toner is unstable in the long-term printing for numerous times (hereinafter also referred to as "during durable printing").

On the other hand, as a means of stabilizing adhesion of an external additive to a toner, JP-2003-295505 A discloses a toner obtainable by melt-kneading a resin binder and the like, thereafter roughly pulverizing the kneaded mixture, mixing the pulverized product with a hydrophobic silica, wherein the amount of the floating external additive can be reduced.

However, the toners specifically disclosed in Examples of JP-2003-295505 A do not sufficiently achieve the improvement in the durability of the dot reproducibility, even in the use of an external additive similar to that disclosed in JP-A-Hei-9-204062.

In addition, JP-A-Hei-11-202551 discloses a technique relating to a color toner obtainable by properly roughly pulverizing a melt-kneaded mixture, pulverizing a mixture prepared by mixing the roughly pulverized product with fine inorganic oxide particles, and classifying the pulverized product, wherein the toner is fixed by feeding a silicone oil to a heat roller at a feeding rate of 10 $\mu g/cm^2$ or less. However, no studies have been made on the dot reproducibility, and the toners specifically disclosed in Examples of JP-A-Hei-11-202551 are desired to have further improvement in the dot reproducibility.

The present inventors have further made studies on the relationship between the properties of the roughly pulverized product obtained by melt-kneading a raw material mixture containing a resin binder, a releasing agent and a colorant, cooling the kneaded mixture, and thereafter roughly pulverizing the mixture, and the external additive, from the viewpoint of further stabilizing the adhesion state of the external additive adhered to the toner. As a result, they have found that a toner obtainable by further pulverizing the roughly pulverized product obtained by selecting a composition containing a wax having a specified melting point as the above-mentioned releasing agent in the presence of an external additive containing inorganic oxides having specified average particle sizes, and classifying the pulverized product dramatically improves the dot reproducibility during the durability printing.

One of the features of the toner for electrostatic image development resides in that the toner is prepared by a process including the steps of:

(I) melt-kneading a raw material mixture containing a resin binder, a releasing agent, and a colorant; cooling the melt-kneaded mixture; and pulverizing (first-pulverizing) the cooled mixture; and (II) further pulverizing (second-pulverizing) a pulverization product obtained in the step (I) in the presence of an external additive; and classifying the pulverized product, and that those described below are used as the releasing agent and the external additive.

In the releasing agent in the step (I), it is necessary to use a releasing agent containing a wax having a melting point of from 65° to 100° C. (hereinafter also referred to as "specified wax").

The term "wax" as used herein generally refers to a wax as described in "Iwanami Rikagaku Jiten (Iwanami Physicochemical Dictionary)," Fourth Edition, p. 1407. The specified wax in the present invention has a melting point of preferably from 70° to 90° C., and more preferably from 75° to 85° C., from the viewpoint of improving durability of the dot reproducibility.

By pulverizing a roughly pulverized product containing the specified wax in the presence of specified inorganic oxides described later, a toner capable of achieving stable dot reproducibility can be obtained even in the repetition of a continuous printing for numerous times. Although not wanting to be limited by theory, this is presumably due to the fact that the stability in the adhesion state of the specified inorganic oxides to the toner is dramatically improved.

The specified wax in the present invention includes, for instance, synthetic waxes such as polypropylene wax, polyethylene wax and Fischer-Tropsch wax; coal waxes such as montan wax; alcohol waxes; petroleum waxes; waxes containing hydroxy acid ester; and the like. When the polyester is used as a resin binder, it is preferable that the wax is the wax containing hydroxy acid ester, from the viewpoint of dispersibility of the wax into the polyester.

The wax containing hydroxy acid ester includes natural waxes such as carnauba wax, rice wax and montan wax; synthetic wax containing hydroxy acid ester, such as ceryl-ω-hydroxycerotate, ceryl-ω-hydroxymelissate, and myricyl-ω-hydroxymelissate; and the like. The natural waxes are more preferable, from the viewpoint of securing offset resistance in a wider temperature range, and carnauba wax is even more preferable.

Further, when the polyester is used as the resin binder, the content of the hydroxy acid ester in the wax is preferably 20% by weight or more, more preferably 30% by weight or more, even more preferably 40% by weight or more, and even more preferably 50% by weight or more, from the viewpoint of the dispersibility of the wax.

It is preferable the wax containing hydroxy acid ester is together with a petroleum wax from the viewpoint of satisfying fixing ability and durability.

The petroleum wax refers to paraffin waxes, microcrystalline waxes, and petrolatum, as prescribed in Japan Industry Standard JIS K2235. In the present invention, one or more kinds of these can be selected.

The combination of the wax containing hydroxy acid ester and the petroleum wax in the present invention is preferably one or more members selected from rice wax and carnauba wax, and one or more members selected from microcrystalline waxes and paraffin waxes, from the viewpoint of satisfying fixing ability and durability, and the carnauba wax and the paraffin wax are even more preferable.

It is preferable that the melting point of the petroleum wax is lower than the wax containing hydroxy acid ester, from the viewpoint of dispersibility. The difference in melting point between the wax containing hydroxy acid ester and the petroleum wax is preferably 20° C. or less, more preferably 15° C. or less, even more preferably 10° C. or less, and even more preferably 5° C. or less, from the viewpoint of compatibility.

The weight ratio of the wax containing hydroxy acid ester to the petroleum wax (the wax containing hydroxy acid ester/the petroleum wax) is preferably from 1/9 to 9/1, more preferably from 3/7 to 8/2, from the viewpoint of dispersibility, and even more preferably from 3/7 to 7/3, even more preferably from 4/6 to 7/3, and even more preferably from 5/5 to 7/3, from the viewpoint of jumping property, and even more preferably from 6/4 to 7/3, from the viewpoint of further dispersibility.

The content of the specified wax (for instance, in the case of the combined use of the wax containing hydroxy acid ester and the petroleum wax as the specified waxes, a total content of both the components) is preferably 2 parts by weight or more, more preferably 3 parts by weight or more, even more preferably 4 parts by weight or more, and even more preferably 5 parts by weight or more, based on 100 parts by weight of the resin binder, from the viewpoint of securing dot reproducibility and offset resistance in a wider temperature range. In addition, the content of the specified wax is preferably 30 parts by weight or less, more preferably 25 parts by weight or less, even more preferably 20 parts by weight or less, and even more preferably 15 parts by weight or less, based on 100 parts by weight of the resin binder, from the viewpoint of the durability of the toner. The content of the specified wax is preferably from 2 to 30 parts by weight, more preferably from 3 to 25 parts by weight, even more preferably from 4 to 20 parts by weight, and even more preferably from 5 to 15 parts by weight, based on 100 parts by weight of the resin binder, from the overall viewpoint.

The releasing agent usable in the toner of the present invention may contain a wax other than the specified wax within the range which would not lose the effects of the present invention. The content of the specified wax in the entire weight of the releasing is preferably from 20% by weight or more, more preferably from 30% by weight or more, even more preferably from 40% by weight or more, even more preferably from 50% by weight or more, even more preferably from 70% by weight or more, and even more preferably from 100% by weight.

The external additive in said step (II) contains an inorganic oxide subjected to hydrophobic treatment having an average particle size of 4 nm or more and less than 20 nm (hereinafter referred to as an "inorganic oxide A"), and an inorganic oxide subjected to hydrophobic treatment having an average particle size of 20 nm or more and 100 nm or less (hereinafter referred to as an "inorganic oxide B"). In the present invention, the average particle size of the inorganic oxide refers to a number-average particle size, which is an average taken from particle sizes of 500 particles determined from a photograph taken with a scanning electron microscope (SEM) of the inorganic oxide.

The external additive as used in the present invention refers to fine particles other than the toner, which is added in the step after the melt-kneading of the raw material mixture containing a resin binder and the like.

The inorganic oxide usable as the external additive in the present invention is preferably, for instance, an inorganic oxide selected from the group consisting of silica, titania, alumina, zinc oxide, magnesium oxide, cerium oxide, iron oxide, copper oxide and tin oxide. Among them, it is preferable that at least one of the inorganic oxides is silica from the viewpoint of giving chargeability and fluidity. In other words, it is preferable that at least one of the inorganic oxide A and the inorganic oxide B is a hydrophobic silica.

As the silica, those prepared by a known method can be used. Those prepared by dry method or high-temperature hydrolysis method are preferable from the viewpoint of dispersibility of the silica.

The inorganic oxide A and the inorganic oxide B mentioned above (hereinafter also collectively referred to as "specified inorganic oxides") are inorganic oxides subjected to hydrophobic treatment.

The inorganic oxide subjected to hydrophobic treatment as used herein refers to an inorganic oxide having a degree of hydrophobicity of 40 or more, preferably from 50 to 99, and more preferably from 60 to 98, as determined by a methanol titration method. The determination of the degree of hydrophobicity according to the methanol titration method is more specifically carried out by the following method. Specifically, 0.2 g of an inorganic oxide of which degree of hydrophobicity is to be determined is placed in a glass container having an inner diameter of 7 cm and a capacity of 2 liters or more containing 100 ml of ion-exchanged water, and the mixture is stirred with a magnetic stirrer. The procedures of placing a tip end of a burette containing methanol into the liquid, adding 20 ml of methanol dropwise thereto while stirring, stopping the stirring after 30 seconds, and observing the state after one minute from stopping the stirring are repeatedly carried out. The value obtained by the following formula is calculated when a total amount of methanol when the inorganic oxide no longer floats on the water surface after one minute from stopping the stirring is defined as Y (ml). The determination was made by temperature-controlling water inside the beaker (glass container) to 20°±1° C.

Degree of Hydrophobicity=(Y/(100+Y))×100

The hydrophobic treatment agent used in the hydrophobic treatment of the inorganic oxide is not particularly limited. The hydrophobic treatment agent for giving negative chargeability includes silane coupling agents such as hexamethyl disilazane (HMDS), dimethyl dichlorosilane (DMDS), isobutyl trimethoxysilane, and octyl silane; silicone oil treatment agents such as dimethyl silicone oil; and the like. In the present invention, it is preferable that at least one of the hydrophobic treatment agents is selected from the silane coupling agents from the viewpoint of reduction in toner aggregation during the pulverizing step in the step (II).

The hydrophobic treatment agent for giving positive chargeability includes aminosilanes; silicone oil treatment agents such as amino-modified silicone oils and epoxy-modified silicone oils; and the like. Among them, the amino-modified silicone oils are preferable because of the excellent dispersion state on the toner surface when combined with the negatively chargeable inorganic oxide.

In the present invention, it is preferable that the inorganic oxide A and the inorganic oxide B have the same charging polarity, from the viewpoint of suppressing the aggregation of the specified inorganic oxides, and further improving dot reproducibility during the durability printing. In the case where the roughly pulverized product obtained in the step (I) is negatively chargeable, it is preferable that at least one of the specified inorganic oxides is negatively chargeable, and even more preferable that both the specified inorganic oxides are negatively chargeable. On the other hand, when the roughly pulverized product obtained in the step (I) is positively chargeable, at least one of the specified inorganic oxides is positively chargeable, and even more preferable that both the specified inorganic oxides are positively chargeable. Here, the chargeability of the roughly pulverized product can be determined from the resin binder and the charge control agent contained in the mixture. In addition, the phrase "inorganic oxide is negatively chargeable or negatively chargeable inorganic oxide" refers to one having a negative triboelectric charge when the inorganic oxide and iron powder is subjected to triboelectric charging, and the phrase "inorganic oxide is positively chargeable or positively chargeable inorganic oxide" refers to one having a positive triboelectric charge when the inorganic oxide and iron powder is subjected to triboelectric charging. The triboelectric charge of the inorganic oxide is determined with a blowoff-type triboelectric charge measuring apparatus. In the present invention, the triboelectric charge of the negatively chargeable inorganic oxide is preferably from −10 to −500 μC/g, and more preferably from −20 to −400 μC/g. In addition, the triboelectric charge of the positively chargeable inorganic oxide is preferably from 10 to 500 μC/g, and more preferably from 20 to 400 μC/g.

The treated amount of the hydrophobic treatment agent in the inorganic oxide is not particularly limited, as long as the treated amount is in an extent that the desired triboelectric charge and degree of hydrophobicity are obtained. It is preferable that the treated amount per surface area of the inorganic oxide is preferably from 1 to 7 $mg/m^2$.

Supposing that the combination of the hydrophobic treatment agent and the inorganic oxide is listed as "hydrophobic treatment agent-inorganic oxide," the preferred combination in the negatively chargeable inorganic oxide includes hexamethyl disilazane (HMDS)-silica, dimethyl dichlorosilane (DMDS)-silica, silicone oil-silica, a mixture of HMDS and silicone oil-silica, isobutyl trimethoxysilane-titania, silicone oil-titania, octyl silane-titania, and the like. Among them, HMDS-silica, DMDS-silica, silicone oil-silica, a mixture of HMDS and silicone oil-silica, and isobutyl trimethoxysilane-titania are preferable, HMDS-silica, DMDS-silica, silicone oil-silica, and a mixture of HMDS and silicone oil-silica are more preferable, even more preferably HMDS-silica and DMDS-silica, and even more preferably HMDS-silica.

As the negatively chargeable inorganic oxide subjected to hydrophobic treatment mentioned above, those commercially available can be used.

The preferred commercially available products of HMDS-silica include H3004, H2000, HDK H30TM, HDK H20TM, HDK H13TM, and HDK H05TM (hereinabove commercially available from Wacker Chemicals), TS530 and EPA-AN0390 (hereinabove commercially available from Cabot Corporation), RX300, RX200, RX50, and NAX-50 (hereinabove commercially available from Nippon Aerosil) and the like.

The preferred commercially available products of DMDS-silica include R976, R974, and R972 (hereinabove commercially available from Nippon Aerosil) and the like.

The preferred commercially available products of silicone oil-silica include HDK H30TD, HDK H20TD, HDK H13TD, and HDK H05TD (hereinabove commercially available from Wacker Chemicals), TS720 (hereinabove commercially available from Cabot Corporation), RY-50 and NY-50 (hereinabove commercially available from Nippon Aerosil), and the like.

The preferred commercially available products of a mixture of HMDS and silicone oil-silica include HDK H30TX, HDK H20TX, HDK H13TX, HDK H05TX (hereinabove commercially available from Wacker Chemicals), and the like.

The preferred commercially available products of isobutyl trimethoxysilane-titania include JMT-150IB (hereinabove commercially available from Tayca, and the like.

On the other hand, the preferred combination in the positively chargeable inorganic oxide includes amino-modified silicone oil-silica, aminosilane-silica, epoxy-modified silicone oil-silica and the like. The amino-modified silicone oil-silica is more preferable.

As the positively chargeable inorganic oxide subjected to hydrophobic treatment mentioned above, those commercially available can be used.

The preferred commercially available products of amino-modified silicone oil-silica include HVK2150, HDK3050, HDK H30TA, HDK H13TA, HDK H05TA (commercially available from Wacker Chemicals) and the like.

The preferred combination of the negatively chargeable inorganic oxide and the positively chargeable inorganic oxide [negatively chargeable inorganic oxide/positively chargeable inorganic oxide] is one that contains HMDS-silica/amino-modified silicone oil-silica or DMDS-silica/amino-modified silicone oil-silica, and more preferably one that contains DMDS-silica/amino-modified silicone oil-silica.

The average particle size of the inorganic oxide A is 4 nm or more, and preferably 6 nm or more, and more preferably 8 nm or more, from the viewpoint of excellent adhesion of the inorganic oxide to the roughly pulverized product and prevention of complete embedment of the inorganic oxide in the toner during the pulverization. The average particle size of the inorganic oxide A is less than 20 nm, preferably 16 nm or less, and more preferably 14 nm or less, from the viewpoint of excellent dispersion on the toner surface. The average particle size of the inorganic oxide A is preferably 4 nm or more and less than 20 nm, more preferably from 4 to 16 nm, and even more preferably from 8 to 14 nm, from the overall viewpoint.

The average particle size of the inorganic oxide B is 20 nm or more, and preferably 30 nm or more, and more preferably 35 nm or more, from the viewpoint of durability. The average particle size of the inorganic oxide B is 100 nm or less, preferably 80 nm or less, more preferably 60 nm or less, and even more preferably 50 nm or less, from the viewpoint of prevention of freeing of the silica. The average particle size of the inorganic oxide B is preferably from 20 to 100 nm, more preferably from 30 to 80 nm, and even more preferably from 35 to 60 nm, from the overall viewpoint.

The weight ratio of the inorganic oxide A to the inorganic oxide B (inorganic oxide A/inorganic oxide B) is preferably from 90/10 to 10/90, more preferably from 80/20 to 40/60, and even more preferably from 70/30 to 50/50.

The formulation amount of the inorganic oxide A and the inorganic oxide B in terms of the total amount of the inorganic oxides A and B is preferably from 0.1 to 20 parts by weight, and more preferably from 0.5 to 6 parts by weight, based on 100 parts by weight of the pulverized product obtained in the step (I), from the viewpoint of environmental stability.

In the external additive which is present during the step (II) may contain fine particles other than the above-mentioned specified inorganic oxides, for instance, an inorganic oxide not subjected to hydrophobic treatment or resin fine particles within the range which would not hinder the effects by the specified inorganic oxides. However, the content of the inorganic oxide A and the inorganic oxide B in the external additive used in the step (II) is preferably from 50 to 100% by weight, more preferably from 70 to 100% by weight, even more preferably from 90 to 100% by weight, and even more preferably from 100% by weight, from the viewpoint of environmental stability.

The toner of the present invention can be prepared by a process including the step of:

(I) melt-kneading a raw material mixture; cooling the melt-kneaded mixture; and pulverizing (first-pulverizing) the cooled mixture; and (II) further pulverizing (second-pulverizing) the pulverized product obtained in the step (I) in the presence of an external additive containing specified inorganic oxides; and classifying the pulverized product.

In the step (I), as the raw material mixture to be melt-kneaded, there is used raw material mixture containing a resin binder, a releasing agent and a colorant.

The resin binder in the present invention includes polyesters, vinyl resins such as styrene-acrylic resins, epoxy resins, polycarbonates, polyurethanes, hybrid resins containing two or more resin components, and the like. Among them, from the viewpoint of low-temperature fixing ability and transparency, the polyester and the hybrid resin are preferable, and the polyester is more preferable. The content of the polyester is preferably 50% by weight or more, more preferably 65% by weight or more, even more preferably 80% by weight or more, even more preferably 90% by weight or more, and even more preferably 100% by weight, of the resin binder, from the viewpoint of low-temperature fixing ability and transparency.

As the raw material monomers for the polyester, an alcohol component containing dihydric or higher polyhydric alcohols, and a carboxylic acid component containing dicarboxylic or higher polycarboxylic acid compounds such as dicarboxylic or higher polycarboxylic acids, acid anhydrides thereof and esters thereof.

The alcohol component includes dihydric alcohols such as an alkylene (2 or 3 carbon atoms) oxide (average number of moles: 1 to 16) adduct of bisphenol A, such as polyoxypropylene(2.2)-2,2-bis(4-hydroxyphenyl)propane and polyoxyethylene(2.2)-2,2-bis(4-hydroxyphenyl)propane, ethylene glycol, and propylene glycol; and the trihydric or higher polyhydric alcohols such as glycerol and pentaerythritol.

In addition, the carboxylic acid component includes dicarboxylic acids such as phthalic acid, isophthalic acid, terephthalic acid, fumaric acid, maleic acid, a substituted succinic acid of which substituent is an alkyl group having 1 to 20 carbon atoms or an alkenyl group having 2 to 20 carbon atoms, such as dodecenylsuccinic acid or octylsuccinic acid; and tricarboxylic or higher polycarboxylic acids such as 1,2,4-benzenetricarboxylic acid (trimellitic acid) and pyromellitic acid; acid anhydrides thereof, alkyl (1 to 8 carbon atoms) esters thereof, and the like.

Further, the alcohol component and the carboxylic acid component may properly contain a monohydric alcohol and a monocarboxylic acid, from the viewpoint of adjusting the molecular weight or the like.

The polyester can be prepared by, for instance, polycondensation of the alcohol component and the carboxylic acid component at a temperature of from 180° to 250° C. in an inert gas atmosphere, in the presence of an esterification catalyst as desired.

The polyester has an acid value of preferably from 0.5 to 60 mg KOH/g, from the viewpoint of the dispersibility of the colorant and chargeability of the toner, and a hydroxyl value of from 1 to 60 mg KOH/g.

In addition, the polyester has a softening point of preferably from 80° to 165° C., and a glass transition temperature of preferably from 50° to 90° C.

In the present invention, the hybrid resin is preferably a resin in which two or more resin components are partially chemically bonded to each other. The hybrid resin may be obtained by using two or more resins as raw materials, or the hybrid resin may be obtained by using a mixture of one resin and raw material monomers for the other resin, or also a mixture of raw material monomers for two or more resins. In order to efficiently obtain a hybrid resin, those obtained from a mixture of raw material monomers of raw material monomers for two or more resins are preferable.

Therefore, it is preferable that the hybrid resin is obtained by mixing raw material monomers for two polymerization resins each having independent reaction paths, preferably raw material monomers for the polyester and raw material monomers for the vinyl resin, and carrying out the two polymerization reactions. Specifically, the hybrid resin disclosed in JP-A-Hei-10-087839 (U.S. Pat. No. 5,908,727) is preferable.

As the colorants in the present invention, all of the dyes, pigments and the like which are used as colorants for toners can be used. The colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. The toner of the present invention may be any of black toners, color toners and full-color toners. The amount of the colorant used is preferably from 1 to 40 parts by weight, and more preferably from 3 to 10 parts by weight, based on 100 parts by weight of the resin binder.

In the toner of the present invention, additives such as charge control agents, fluidity improvers, electric conductivity modifiers, extenders, reinforcing fillers such as fibrous substances, antioxidants, anti-aging agents, and cleanability improvers may be appropriately added.

The melt-kneading of the raw material mixture can be carried out by, for instance, a closed type kneader, a closed type single-screw or twin-screw extruder, an open-roller type kneader and the like. In the present invention, it is preferable to use an open-roller type kneader, from the viewpoint of improving dot reproducibility during durability printing of the toner. By the use of the open-roller type kneader, the dispersion of the specified releasing agent in the resin binder is accelerated, so that it is presumed that the adhesion state of the specified inorganic oxides to the toner is further stabilized. Incidentally, the temperature of the melt-kneading is not particularly limited as long as each of the raw material mixture is sufficiently miscible with each other. It is preferable that the temperature of the melt-kneading is usually from 80° to 140° C.

The open-roller type kneader in the present invention refers to a kneader containing at least two rollers, and a melt-kneading member is an open type, and it is preferable that at least two of the rollers are a heat roller and a cooling roller. The open-roller type kneader can easily dissipate the kneading heat generated during the melt-kneading. In addition, it is preferable that the open-roller type kneader is a continuous type kneader, from the viewpoint of production efficiency.

Further, in the above-mentioned open-roller type kneader, two of the rollers are arranged in parallel closely to each other, and the gap between the rollers is preferably from 0.01 to 5 mm, and more preferably from 0.05 to 2 mm. In addition, structures, sizes, materials and the like of the roller are not particularly limited. Also, the roller surface may be any of smooth, wavy, rugged or other surfaces.

The number of rotation of the roller, i.e. the peripheral speed of the roller, is preferably from 2 to 100 m/min. The peripheral speed of the cooling roller is preferably from 2 to 100 m/min, more preferably from 10 to 60 m/min, and even more preferably from 15 to 50 m/min. In addition, it is preferable that the two rollers have different peripheral speeds from each other, and that the ratio of the peripheral speed of the two rollers (cooling roller/heat roller) is preferably from 1/10 to 9/10, and more preferably from 3/10 to 8/10.

In order that the kneaded product is easily adhered to the heat roller, it is preferable that the temperature of the heat roller is adjusted to be higher than both the temperatures of the softening point of the resin binder and the melting point of the wax, and that the temperature of the cooling roller is adjusted to be lower than both the temperatures of the softening point of the resin binder and the melting point of the wax.

The difference in temperature between the heat roller and the cooling roller is preferably from 60° to 150° C., and more preferably from 80° to 120° C.

Here, the temperature of the roller can be adjusted by a heating medium passing through the inner portion of the roller, and each roller may be divided in two or more portions in the inner portion of the roller, each being connected to heating media of different temperatures.

It is preferable that the temperature of the heat roller, especially the raw material feeding side of the heat roller is adjusted to be higher than both the softening point of the resin binder and the melting point of the wax, more preferably higher than the higher of the softening point of the resin binder and the melting point of the wax by 0° to 80° C., and even more preferably by 5° to 50° C. It is preferable that the temperature of the cooling roller is adjusted to be lower than both of the softening point of the resin binder and the melting point of the wax, more preferably lower than the lower of the softening point of the resin binder and the melting point of the wax by 0° to 80° C., and even more preferably by 40° to 80° C.

Next, the resulting kneaded mixture is cooled to a pulverizable hardness, and subjected to a pulverization (a first pulverization). In the present invention, the first pulverization is a rough pulverization. In this pulverization, the kneaded mixture is pulverized to a size so that the average particle size of the resulting pulverized product (roughly pulverized product) is preferably from 0.03 to 4 mm, more preferably from 0.05 to 2 mm, and even more preferably the above-mentioned average particle size, and a maximum particle size of 5 mm or less, even more preferably the above-mentioned average particle size, and a maximum particle size of 3 mm or less, and even more preferably the average particle size of from 0.05 to 2 mm and the maximum particle size of 3 mm or less.

Here, the average particle size of the roughly pulverized product refers to an average of the maximum length of the projected area when the product is observed with a microscope, and the phrase "the maximum particle size of 5 mm or less" means all of the toner particles pass through a sieve of which sieve opening is 5 mm.

The pulverizer usable in the rough pulverization includes atomizer, Rotoplex, and the like.

In the present invention, in the subsequent step (II), the roughly pulverized product is pulverized (second pulverization) in the presence of an external additive containing specified inorganic oxides, whereby the filming resistance of the finally obtained toner can be even more improved. Such an improvement is presumably due to the fact that the specified inorganic oxides on the toner surface is even more uniformly dispersed and adhered, as compared to a usual method of externally adding an inorganic oxide in the final step of the toner preparation.

In the step (II), when the roughly pulverized product is pulverized in the presence of an external additive containing the specified inorganic oxides, it is preferable that the roughly pulverized product is mixed with the above-mentioned external additive containing the specified inorganic oxides, and further pulverized, from the viewpoint of further increasing effects for dot reproducibility.

In the mixing of the roughly pulverized product with the external additive in the step (II), it is preferable to use an agitator containing an agitation member such as rotating impeller, from the viewpoint of uniform dispersion of a specified external additive. The number and shape of the rotating impeller may be properly designed according to the scale of the agitator, and it is preferable to use two or more agitation impellers in an agitator. The agitation member is preferably positioned at an upper portion of the mixing member, from the viewpoint of continuous treatment of the pulverized product.

The mixing conditions for the roughly pulverized product with the external additive to be present during the step (II) are not particularly limited, as long as both the components can be sufficiently mixed, and can be properly determined according to the scale of the agitator. When an agitator of a batch-process having a capacity of about 10 liters is used, it is preferable that the mixing is carried out at a rotational speed of from 2000 to 5000 r/min for 30 seconds to 2 minutes or so. In addition, when an agitator of a continuous-process having a capacity of about 5 liters is used, it is preferable that the mixing is carried out at a residence time of from 1 to 60 seconds.

In the present invention, the more sufficiently the roughly pulverized product and the external additive are agitated, the more excellent the dot reproducibility during the durability printing of the toner. As a specific measure, it is preferable that the mixing is carried out until the aggregate of the inorganic oxide is not visually confirmed, and further that the external additive is uniformly dispersed when the roughly pulverized product is observed with a scanning electron microscope (SEM).

In the step (II), when the roughly pulverized product is further pulverized in the presence of the external additive, there can be used a jet mill such as impact type mill; rotary mechanical mill or the like. In the present invention, the jet mill is preferable, from the viewpoint of adhesion stability of the inorganic oxides A and B on the toner surface, and more preferably impact type mill.

The air pressure upon pulverizing when using a jet mill, specifically the pressure of pulverization air introduced into the pulverization nozzle is preferably from 0.2 to 1 MPa, more preferably from 0.3 to 0.8 MPa, and even more preferably from 0.4 to 0.7 MPa.

In the present invention, in order to continuously produce on an industrial scale, it is preferable that the processes from the mixing of the roughly pulverized product with the external additive to the pulverization (a second pulverization) are continuously carried out, i.e. the roughly pulverized product and the external additive are subjected to continuous mixing, and the resulting mixture is continuously subjected the second pulverization.

The pulverized product obtained by the second pulverization (finely pulverized product) has a volume-average particle size ($D_{50}$) of preferably 15 μm or less, more preferably from 3 to 10 μm, and even more preferably from 3 to 8 μm.

By classifying the finely pulverized product, the toner can be obtained. The classifier usable in the classification includes air classifiers, rotor type classifiers, sieve classifiers, and the like.

The toner has a volume-average particle size ($D_{50}$) of preferably from 3.5 to 11 μm or less, more preferably from 3.5 to 9 μm, and even more preferably from 4 to 8 μm.

The toner of the present invention may be those obtainable by a process further including the step, subsequent to the step (II), of:

(III) mixing an external additive such as the specified inorganic oxides usable in the step (II), the other inorganic oxide such as silica, and resin fine particles composed of polytetrafluoroethylene or the like.

In the mixing of the finely pulverized product or the toner particles obtained after the classifying step with an external additive, it is preferable to use an agitator having an agitation member such as rotary impeller, and an even more preferred agitator includes a Henschel mixer.

The toner of the present invention can exhibit excellent dot reproducibility not only at the initial printing even in durability printing in an oil-less electrostatic image developer device. Here, the oil-less electrostatic image developer device includes an apparatus containing a heat roller fixing device but without an oil-feeding device. The oil-feeding device includes a device equipped with an oil tank, having mechanism of applying an oil to a heat roller surface in a given amount, a device having mechanism so that a roller previously immersed in an oil is brought into contact with a heat roller, and the like.

The toner of the present invention can be used without particular limitation in any of the development method alone as a developer in the case where fine magnetic material powder is contained, or as a nonmagnetic monocomponent developer or as a two-component developer by mixing the toner with a carrier in the case where fine magnetic material powder is not contained. The toner of the present invention can be even more suitably used as a toner for nonmagnetic monocomponent development, from the viewpoint obtaining high image quality.

EXAMPLES

The following examples further describe and demonstrate embodiments of the present invention. The examples are given solely for the purposes of illustration and are not to be construed as limitations of the present invention.

[Melting Point of Wax]

A maximum peak temperature for heat of fusion is determined with a sample using a differential scanning calorimeter (DSC 210, manufactured by Seiko Instruments, Inc.), when the sample is treated by raising its temperature to 200° C., cooling the sample at a cooling rate of 10° C./min. to 0° C., and thereafter heating the sample at a heating rate of 10° C./min. Here, the maximum peak temperature is defined as a melting point of a wax.

[Triboelectric Charges of Inorganic Oxide]

The amount 0.01 g of an inorganic oxide and 9.99 g of iron powder carrier having a particle size of from 100 to 200 mesh (sieve opening: 85 to 200 μm) are weighed and placed in a 20 ml glass bottle, and the mixture is stirred at 250 r/min with a ball-mill for 10 minutes, to prepare a sample.

The triboelectric charges of the prepared sample are measured by a blow-off type electric charge measuring device equipped with a Faraday cage, a capacitor and an electrometer. Specifically, W (g) of the prepared sample is placed into a brass measurement cell equipped with a stainless screen of 400 mesh (sieve opening: 30 μm). Next, after aspirating from a suction opening for 5 seconds, blowing is carried out for 5 seconds under a pressure indicated by a barometric regulator of 0.6 $kgf/m^2$, thereby selectively removing only the inorganic oxide from the cell.

In this case, the voltage of the electrometer after 2 seconds from the start of blowing is defined as V (volt). Here, when the electric capacitance of the capacitor is defined as C (μF), the triboelectric charge of the inorganic oxide is calculated by the following equation:

$$\text{Triboelectric charges } (\mu C/g)=(C\times V)/0.001\ W.$$

[Volume-Average Particle Size ($D_{50}$) of Toner and Finely Pulverized Product]

Measuring Apparatus: Coulter Multisizer II (commercially available from Beckman Coulter)

Aperture Diameter: 100 μm

Range of Determined Particle Size: 2 to 60 μm

Analyzing Software: Coulter Multisizer AccuComp Ver. 1.19 (commercially available from Beckman Coulter)

Electrolyte: Isotone II (commercially available from Beckman Coulter)

Dispersion: 5% electrolyte of EMULGEN 109P (commercially available from Kao Corporation, polyoxyethylene lauryl ether, HLB: 13.6)

Dispersing Conditions: Ten milligrams of a test sample is added to 5 ml of a dispersion, and the resulting mixture is dispersed in an ultrasonic disperser for 1 minute. Thereafter, 25 ml of an electrolyte is added to the dispersion, and the resulting mixture is dispersed in an ultrasonic dispersing apparatus for another 1 minute.

Measurement Conditions: One-hundred milliliters of an electrolyte and a dispersion are added to a beaker, and the particle sizes of 30000 particles are determined under the conditions for concentration satisfying that the determination for 30000 particles are completed in 20 seconds, to obtain a volume-average particle size ($D_{50}$) from its particle size distribution.

Resin Preparation Example 1

The amount 714 g of polyoxypropylene(2.2)-2,2-bis(4-hydroxyphenyl)propane, 663 g of polyoxyethylene(2.2)-2,2-bis(4-hydroxyphenyl)propane, 518 g of isophthalic acid, 70 g of isooctenylsuccinic acid, 80 g of trimellitic acid and 2 g of dibutyltin oxide were reacted while stirring at 210° C. under a nitrogen gas atmosphere until the softening point as determined by ASTM D36-86 reached 120° C., to give a resin A.

Examples 1 to 4

One-hundred parts by weight of the resin A, 3 parts by weight of a blue colorant (Pigment Blue 15:3), a releasing agent shown in Table 1, and 1 part by weight of a negatively chargeable charge control agent "BONTRON E-84" (commercially available from Orient Chemical Co., Ltd.) were supplied into a Henschel mixer, and the mixture was mixed at a mixer temperature of 40° C. for 2 minutes, while stirring, to give a raw material mixture. The resulting raw material mixture was melt-kneaded with a continuous-type twin-screw kneader at 100° C., to give a kneaded mixture. The resulting kneaded mixture was cooled in the air, and roughly pulverized with an atomizer (commercially available from Tokyo Atomizer Manufacturing), and the roughly pulverized product was passed through a sieve having a sieve opening of 2 mm, to give a roughly pulverized product having a maximum diameter of 2 mm or less. One-hundred parts by weight of the resulting roughly pulverized product and an external additive a shown in Table 1 were mixed with a Henschel mixer for 1 minute. The roughly pulverized product adhered with an external additive a was finely pulverized with a jet mill pulverizer (commercially available from Nippon Pneumatic Mfg. Co., Ltd.) of which air pressure during the pulverization was adjusted to 0.4 MPa, and the finely pulverized product was further classified, to give a toner having a volume-average particle size ($D_{50}$) of 7.0 μm.

Examples 5 and 6 and Comparative Examples 1 to 4

The same procedures as in Example 1 were carried out except that the raw materials as shown in Table 1 were melt-kneaded with a continuous twin open-roller type kneader "Kneadex" (commercially available from MITSUI MINING COMPANY, LIMITED) in place of the continuous-type twin-screw kneader, to give a toner.

Incidentally, the continuous twin open-roller type kneader used has a roller having an outer diameter of 0.14 m and an effective length of 0.8 m, and the operating conditions are a rotational speed of a higher rotation side roller (front roller) of 75 r/min, a rotational speed of a lower rotation side roller (back roller) of 50 r/min, and a gap between the rollers of 0.1 mm. The temperature of the heating medium and the cooling medium inside the rollers are as follows. The higher rotation side roller has a temperature at the raw material supplying side of 150° C., and a temperature at the kneaded mixture discharging side of 130° C., and the lower rotation side roller has a temperature at the raw material supplying side of 35° C., and a temperature at the kneaded mixture discharging side of 30° C. In addition, the feeding rate of the raw material mixture was 5 kg/hour, and the average residence time of about 5 minutes.

In Comparative Example 1, an external additive b shown in Table 1 was further added to 100 parts by weight of the toner particles, and the mixture was mixed with a Henschel mixer for 2 minutes.

Incidentally, all the degrees of hydrophobicity of the external additives used in Examples and Comparative Examples were 60 or more.

Test Example 1

A toner was loaded to an oil-less electrostatic image developer device "SPEEDIA N5" (commercially available from CASIO COMPUTER CO., LTD., resolution: 600 dpi× 600 dpi, printing speed: 29 ppm (A4 paper sheets fed in width direction, 145 mm/second). Fixed images having a printing ratio of 5% were printed continuously for 6000 sheets. During the course of the continuous printing, half-tone fixed images were printed after printing 100 sheets and after printing 6000 sheets. Evenness of half-tone fixed images was visually examined at the initial stage (after printing 100 sheets) and after durability printing (after printing 6000 sheets). The dot reproducibility was evaluated in accordance with the following evaluation criteria. The results are shown in Table 1.

[Evaluation Criteria]

◎◎: The half-tone is very even and smooth.

◎: The half-tone is even and smooth.

○: The half-tone is overall smooth with partial granular feel.

Δ: The half-tone shows some non-uniformity portions and slight granular feel.

×: There are outstanding non-uniformity portions and granular feel.

××: There are significantly outstanding non-uniformity portions and granular feel.

Test Example 2

The amount 500 g of a toner was loaded in the same developer device as in Test Example 1, and fixed images having a printing ratio of 5% were continuously printed. At a point where "toner-end" was indicated the amount of toner remaining in the toner cartridge was weighed, and the blocking resistance was evaluated in accordance with the following evaluation criteria. Specifically, the larger the blocked toner, the larger the amount of the toner remaining in the toner cartridge. The results are shown in Table 1.

[Evaluation Criteria]

◎◎: The amount of the toner remaining is less than 15 g.

◎: The amount of the toner remaining is 15 g or more and less than 20 g.

○: The amount of the toner remaining is 20 g or more and less than 25 g.

Δ: The amount of the toner remaining is 25 g or more and less than 30 g.

×: The amount of the toner remaining is 30 g or more and less than 40 g.

××: The amount of the toner remaining is 40 g or more.

TABLE 1

| | | Releasing Agent a[1)] | | External Additive a[2)] | | | | | |
|---|---|---|---|---|---|---|---|---|---|
| | Kneader | Wax | Melting Point (° C.) | Inorganic Oxide A | Charge-ability | Average Particle Size | Inorganic Oxide B | Charge-ability | Average Particle Size |
| Ex. 1 | Twin-screw | Carnauba wax/5 | 84 | JMT150IB/1.0 | negative | 15 nm | RY-50/0.5 | negative | 40 nm |
| Ex. 2 | Twin-screw | Carnauba wax/5 | 84 | HDKH30TM/1.0 | negative | 8 nm | EP-AN0390/0.5 | negative | 70 nm |
| Ex. 3 | Twin-screw | Carnauba wax/5 | 84 | HVK2150/1.0 | positive | 12 nm | RY-50/0.5 | negative | 40 nm |
| Ex. 4 | Twin-screw | Carnauba wax/5 | 84 | HDKH20TM/1.0 | negative | 12 nm | RY-50/0.5 | negative | 40 nm |
| Ex. 5 | Open-roller | Carnauba wax/5 | 84 | HDKH20TM/1.0 | negative | 12 nm | RY-50/0.5 | negative | 40 nm |
| Ex. 6 | Open-roller | Carnauba wax/3<br>Paraffin wax/2 | 84<br>78 | HDKH20TM/1.0 | negative | 12 nm | RY-50/0.5 | negative | 40 nm |
| Comp. Ex.1 | Open-roller | Carnauba wax/5 | 84 | — | — | — | — | — | — |
| Comp. Ex. 2 | Open-roller | Carnauba wax/5 | 84 | HDKH20TM/1.0 | negative | 12 nm | TSX-55/0.5 | negative | 300 nm |
| Comp. Ex. 3 | Open-roller | Carnauba wax/5 | 84 | HDKH20TM/1.0 | negative | 12 nm | — | — | — |
| Comp. Ex.4 | Open-roller | PP wax/5 | 105 | HDKH20TM/1.0 | negative | 12 nm | RY-50/0.5 | negative | 40 nm |

| | | Dot Reproducibility | | |
|---|---|---|---|---|
| | External Additive b[2)] | Initial (100 Sheets) | After Durability Printing (6000 Sheets) | Blocking Resistance |
| Ex. 1 | — | ○ | ○ | ○ |
| Ex. 2 | — | ○ | Δ | ○ |
| Ex. 3 | — | ◎ | ○ | ◎ |
| Ex. 4 | — | ◎ | ◎ | ◎ |
| Ex. 5 | — | ◎◎ | ◎ | ◎ |
| Ex. 6 | — | ◎◎ | ◎◎ | ◎◎ |
| Comp. Ex.1 | HDKH20TM/0.5<br>RY-50/0.3 | × | ×× | × |
| Comp. Ex. 2 | — | × | × | Δ |
| Comp. Ex. 3 | — | Δ | ×× | × |
| Comp. Ex.4 | — | ○ | × | × |

Note)

The amount of the external additive is expressed by parts by weight.

[1)]Carnauba wax: carnauba wax c1 (commercially available from Kato Yoko), melting point: 84° C.

Paraffin wax: HNP-1 (commercially available from Nippon Seiro), melting pint: 78° C.

TABLE 1-continued

PP wax (polypropylene wax): SP-105 (commercially available from Sazole), melting point: 105° C.
[2)]JMT150IB: commercially available from Tayca, negatively chargeable, −30 μC/g, isobutyl trimethoxysilane-titania, average particle size: 15 nm
HDKH30TM: commercially available from Wacker Chemicals, negatively chargeable, −400 μC/g, HMDS-silica, average particle size: 8 nm
HVK2150: commercially available from Wacker Chemicals, positively chargeable, +150 μC/g, amino-modified silicone oil-silica, average particle size: 12 nm
HDKH20TM: commercially available from Wacker Chemicals, negatively chargeable, −300 μC/g, HMDS-silica, average particle size: 12 nm
RY-50: commercially available from Nippon Aerosil, negatively chargeable, −50 μC/g, silicone oil-silica, average particle size: 40 nm
EPA-AN0390: commercially available from Cabot Corporation, negatively chargeable, −150 μC/g, HMDS-silica, average particle size: 70 nm
TSX-55: commercially available from Shin-Etsu Chemical Co., Ltd., negatively chargeable, −40 μC/g, HMDS-silica, average particle size: 300 nm It can be seen from the above results that the toners of the Examples have excellent dot reproducibility and excellent blocking resistance even after durable printing, as compared to those of the toners of Comparative Examples.

The toner for electrostatic image development of the present invention can be suitably used, for instance, for the development of a latent image formed in electrophotography, electrostatic recording method, electrostatic printing method or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development, obtainable by a process comprising the steps of:

(I) melt-kneading a raw material mixture comprising a resin binder, a releasing agent, and a colorant; cooling the melt-kneaded mixture; and pulverizing the cooled mixture; and (II) further pulverizing a pulverized product obtained in the step (I) in the presence of an external additive; and classifying the pulverized product, wherein the releasing agent in said step (I) comprises a wax having a melting point of from 65° to 100° C., and wherein the external additive in said step (II) comprises an inorganic oxide subjected to hydrophobic treatment having an average particle size of 4 nm or more and less than 20 nm (hereinafter referred to as an "inorganic oxide A"), and an inorganic oxide subjected to hydrophobic treatment having an average particle size of 20 nm or more and 100 nm or less (hereinafter referred to as an "inorganic oxide B").

2. The toner according to claim 1, wherein the step (II) comprises mixing the pulverized product obtained in the step (I) with the external additive, and further pulverizing the resulting mixture, and classifying the pulverized product.

3. The toner according to claim 1, wherein the pulverized product obtained in the step (I) is negatively chargeable, wherein at least one of the inorganic oxide A and the inorganic oxide B has a triboelectric charge of from −10 to −500 μC/g.

4. The toner according to claim 1, wherein at least one of the inorganic oxide A and the inorganic oxide B is a hydrophobic silica.

5. The toner according to claim 1, wherein the melt-kneading of the raw material mixture in the step (I) is carried out with an open-roller type kneader.

6. The toner according to claim 1, wherein the pulverizing step in the step (II) is carried out with a jet mill having an air pressure during pulverization of from 0.2 to 1 MPa.

7. The toner according to claim 1, wherein the toner has a volume-average particle size ($D_{50}$) of from 3.5 to 9 μm.

8. The toner according to claim 1, wherein the inorganic oxide A and the inorganic oxide B are uniformly dispersed on and adhered to a surface of the toner.

9. A process for preparing a toner for electrostatic image development, comprising the steps of:

(I) melt-kneading a raw material mixture comprising a resin binder, a releasing agent, and a colorant; cooling the melt-kneaded mixture; and pulverizing the cooled mixture; and (II) further pulverizing a pulverized product obtained in the step (I) in the presence of an external additive; and classifying the pulverized product, wherein the releasing agent in said step (I) comprises a wax having a melting point of from 65° to 100° C., and wherein the external additive in said step (II) comprises an inorganic oxide subjected to hydrophobic treatment having an average particle size of 4 nm or more and less than 20 nm (hereinafter referred to as an "inorganic oxide A"), and an inorganic oxide subjected to hydrophobic treatment having an average particle size of 20 nm or more and 100 nm or less (hereinafter referred to as an "inorganic oxide B").

10. The process according to claim 9, wherein the step (II) comprises mixing the pulverized product obtained in the step (I) with the external additive, and further pulverizing the resulting mixture, and classifying the pulverized product.

11. The process according to claim 9, wherein the melt-kneading of the raw material mixture in the step (I) is carried out with an open-roller type kneader.

12. The process according to claim 9, wherein the pulverizing step in the step (II) is carried out with a jet mill having an air pressure during pulverization of from 0.2 to 1 MPa.

13. The process according to claim 9, wherein the pulverized product obtained in the step (I) is negatively chargeable, wherein at least one of the inorganic oxide A and the inorganic oxide B has a triboelectric charge of from −10 to −500 μC/g.

14. The process according to claim 9, wherein at least one of the inorganic oxide A and the inorganic oxide B is a hydrophobic silica.

15. The process according to claim 9, wherein the melt-kneading of the raw material mixture in the step (I) is carried out with an open-roller type kneader.

16. The process according to claim 9, wherein the toner has a volume-average particle size ($D_{50}$) of from 3.5 to 9 μm.

17. The process according to claim 9, wherein the pulverized product obtained in the step (I) has an average particle size of from 0.03 to 4 mm.

18. The process according to claim 9, wherein the weight ratio of the inorganic oxide A to the inorganic oxide B is from 90/10 to 10/90.

19. The process according to claim 9, wherein the inorganic oxide A and the inorganic oxide B have the same charging polarity.

20. The toner according to claim 1, wherein the content of the wax is 2 parts by weight or more based on 100 parts by weight of the resin binder.

21. The toner according to claim 1, wherein inorganic oxide A has an average particle size of 4 to 16 nm, and inorganic oxide B has an average particle size of 30 to 80 nm.

22. The toner according to claim 1, wherein inorganic oxide A has an average particle size of 8 to 14 nm, and inorganic oxide B has an average particle size of 35 to 60 nm.

23. The toner according to claim 1, wherein said external additive comprises 90 to 100% by weight of inorganic oxide A and inorganic oxide B.

* * * * *